United States Patent [19]

Binfare'

[11] 4,448,378

[45] May 15, 1984

[54] MODULAR SUPPORTING STRUCTURE FOR TABLES, SMALL TABLES, CHAIRS AND THE LIKE

[75] Inventor: Francesco Binfare', Monza, Italy

[73] Assignee: C.D. & C Centro Design & Communicazione S.r.l., Milan, Italy

[21] Appl. No.: 326,481

[22] Filed: Dec. 2, 1981

[30] Foreign Application Priority Data

Dec. 19, 1980 [IT] Italy ..... 23690/80[U]

[51] Int. Cl.[3] ..... A47B 91/00

[52] U.S. Cl. ..... 248/188.7; 108/150; 248/121; 248/158; 248/165; 403/217

[58] Field of Search ..... 248/188.7, 165, 121, 248/533, 158; 403/217, 218; 108/150

[56] References Cited

U.S. PATENT DOCUMENTS

| | | | |
|---|---|---|---|
| 1,802,279 | 4/1931 | Schmitt | 248/158 |
| 2,466,148 | 4/1949 | Birr | 248/188.7 |
| 3,078,063 | 2/1963 | Frankl | 248/188.7 |
| 3,834,549 | 9/1974 | Burg et al. | 403/218 X |
| 3,837,754 | 9/1974 | Malick | 403/217 |
| 3,877,669 | 4/1975 | Ambasz | 248/188.7 |

FOREIGN PATENT DOCUMENTS

| | | | |
|---|---|---|---|
| 2263142 | 6/1974 | Fed. Rep. of Germany | 248/188.7 |
| 2615527 | 10/1976 | Fed. Rep. of Germany | 248/188.7 |
| 2933712 | 3/1981 | Fed. Rep. of Germany | 403/217 |

*Primary Examiner*—Ramon S. Britts
*Assistant Examiner*—David L. Talbott
*Attorney, Agent, or Firm*—Karl F. Ross; Herbert Dubno

[57] ABSTRACT

A modular furniture support structure comprises first and second pluralities of arm members lying respectively in common upper and lower planes and associated by an upright. Respective ends of the arm members are connected to the uprights, at least the arm members of the second plurality being movably associated with the upright by individually inserting each arm member of the second plurality into clamping jaws effective to be movably engaged with the upright at the other end thereof.

4 Claims, 5 Drawing Figures

MODULAR SUPPORTING STRUCTURE FOR TABLES, SMALL TABLES, CHAIRS AND THE LIKE

FIELD OF THE INVENTION

The present invention relates to a modular supporting structure, particularly for tables, small tables, chairs and the like.

Background of the Invention

A present problem in the furniture industry is that of the availability of supporting structures for tables, small tables, chairs and the like furniture pieces which, in addition to being aesthetic, are easily assembled at low cost.

In order to meet this need, supporting structures have been already introduced on the market which comprise a generally tubular central upright, from the lower and upper ends of which extend respective spider arrangements of arm members, also made of metal tubular material, with the arm members of the lower spider constituting the floor bearing assembly and the arm members of the upper spider defining the table board supporting assembly.

These known structures, on the other hand, are not devoid of drawbacks, the most important of which is that the coupling of the lower and upper arm members to the upright generally requires welding and is rather difficult, requires a lot of time and accordingly is expensive. Moreover these known supporting structures are generally made in standardized size and for specific applications, and they cannot be easily allow for boards of any size to be supported, which is very important in the furniture industry.

Objects of the Invention

Accordingly, the principal object of the present invention is to provide a supporting modular structure for tables, small tables, chairs and the like furniture pieces which can be easily and quickly assembled so that, in particular, the arm members can be easily and quickly coupled with the central upright without any welding operations.

It is another important object of the present invention to provide such a supporting structure which can be realized as a modular unit, effective to be easily and quickly associated with like units in such a way as to afford a possibility of supporting table boards and/or the like of any desired size.

Yet another object of the present invention is to provide a modular supporting and/or bearing structure which is highly flexible and, in particular, effective to be used, with little modification, either as a fixed supporting and/or bearing structure or as a movable supporting structure, in particular supported on casters.

Yet another object of the present invention is to provide a supporting and/or bearing modular structure, in particular for tables, small tables, chairs and the like which is of reduced cost and easily mass produced by the furniture industry.

Summary of the Invention

The task and objects thereinabove mentioned, as well as yet other objects which will become more apparent hereinafter, are achieved with a modular supporting structure for tables, small tables, chairs and the like, comprising a substantially vertically extending tubular column member, a first plurality of arm members associated with said column member at one end thereof and radially extending therefrom, the distal ends of said arm members of said first plurality substantially lying in a first plane, and a second plurality of tubular arm members associated with said column member at the other end thereof, and radially extending therefrom, the distal ends of said arm members of said second plurality substantially lying in a second common plane. According to the invention at least the arm members of said second plurality are movably associated with said column member by individually inserting each said arm member of said second plurality into clamping jaw means effective to be movably engaged with said column member at the other end thereof.

BRIEF DESCRIPTION OF THE DRAWING

Further characteristics and advantages of the modular supporting structure particularly for tables, small tables, chairs and like furniture pieces according to the present invention, will become more apparent hereinafter from the following detailed description of an embodiment thereof, being illustrated by way of example in the accompanying drawing in which.

SPECIFIC DESCRIPTION

Figure 1:
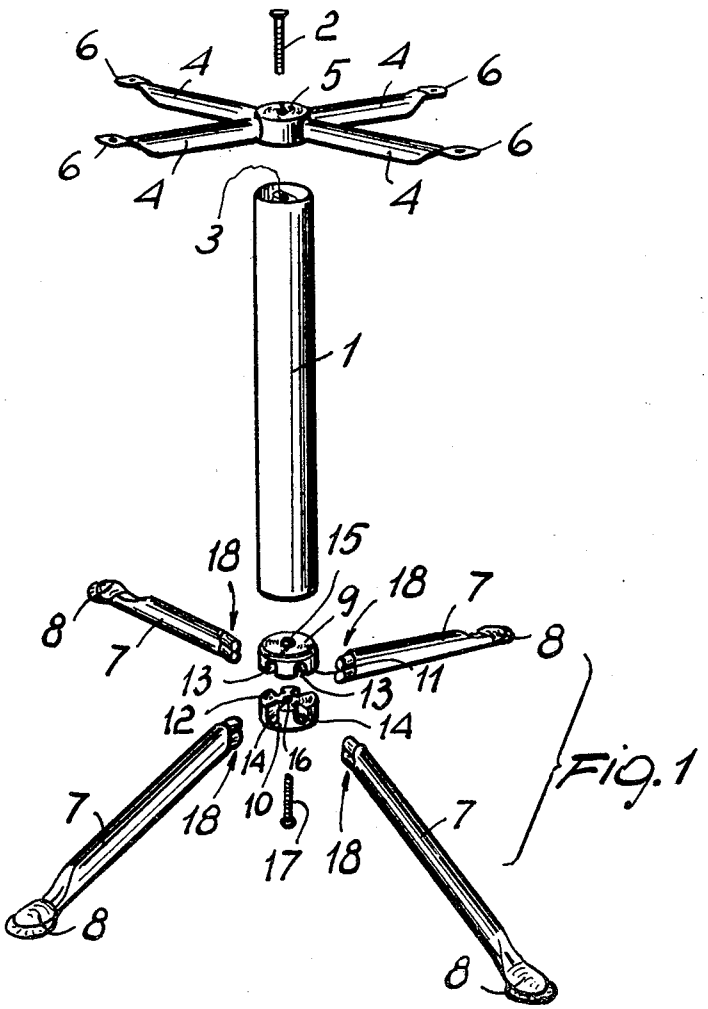
FIG. 1 is a perspective exploded view of a possible embodiment of the supporting structure according to the present invention.

With reference to the drawing and more specifically to FIG. 1, there is illustrated, in an exploded view, the modular supporting structure according to the present invention. As shown, the structure comprises a tubular upright or column member which is associated, for example by a screw 2 engageable with a corresponding axially extending hole 3 of the column member 1, a first plurality of spoke arm members 4 which, in the illustrated embodiment, consist of pressed sheet metal members, having the illustrated shape, and being substantially integral with a hub central member 5. At the free ends thereof the arm members 4 are provided with resting members 6, which can be either integrally formed with the arm members 4 or, in a known way, formed by bearing shoe members.

Said bearing members 6 are provided for supporting the table or the like board.

It should be noted that the column member 1, herein illustrated as consisting of a substantially tubular member, can consist of an assembly spacer members, having any desired cross-sections and shapes, and, in particular, it can consist, in a known way, of two telescopically coupled upright members.

According to the invention, the modular supporting structure comprises a second plurality of arm members, indicated at 7. As is shown at the distal ends thereof, the arms members 7 comprise corresponding floor bearing members 8. The numbers 8, as it should be clear, can consist either of resting shoes rigidly coupled to the respective arm members 7 or of castors.

According to the invention the other ends of the arm members 7 may be clamped in clamping members or means 9 and 10 respectively. As shown, the clamping means 9,10 comprise substantially cylindrical bodies in which a plurality of suitably shaped recesses are formed (four in FIG. 1).

The cylindrical bodies of the clamping means 9 and 10 are provided with respective base portions 11 and 12, substantially flat, effective to be brought to abut one against the other.

As is shown, the recesses 13 and 14 of the clamping means 9 and 10, of like number, in this case four, are opened both on the side surface of the respective cylindrical bodies and on the respective abutment bases 11 and 12. Said clamping jaw means are moreover provided with axially extending holes 15,16, respectively, therein screw members 17 can engage for clamping the jaws and fixing said clamped jaws, with the arm members 7 engaged therein, to the column member or upright 1. To this end, in said column member 1 there will be provided a threaded hole (not shown) engageable by a screw 17.

Figures 2, 4, 5, 6:
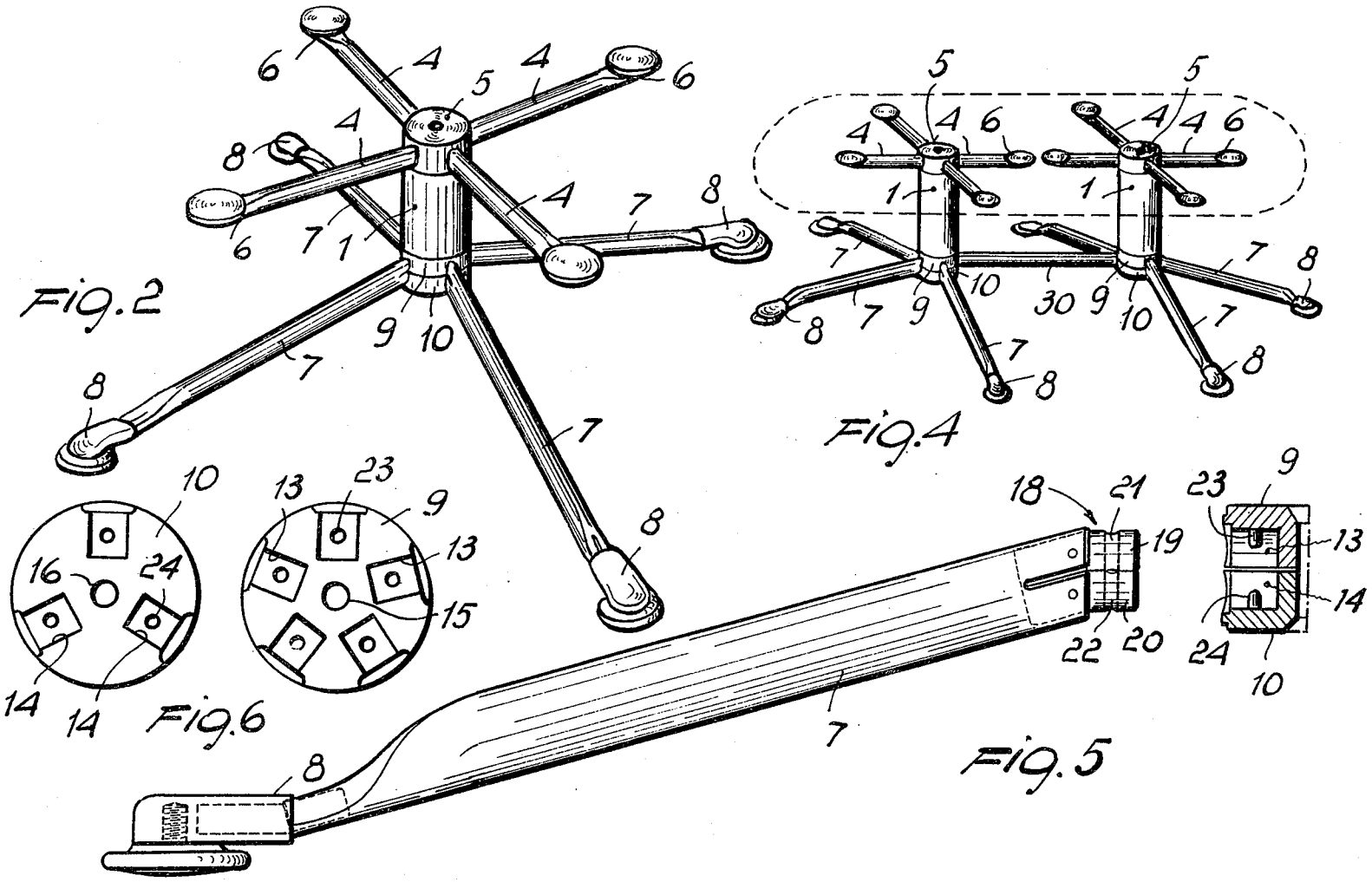
FIG. 2 illustrates another perspective view of that same supporting structure of FIG. 1, in the assembled condition thereof.
FIG. 4 is a schematic view illustrating two modular structures according to the invention as coupled to one another for supporting greater size boards.
FIG. 5 illustrates a detail of the clamping jaw means used in the supporting structure according to the invention.
FIG. 6 is a top view of two possible embodiments of the jaw means used in the supporting structure according to the invention.

For engaging the arm members 17 and the jaws 9,10 the arm members 7, at their engagement ends, are advantageously provided with engaging means, indicated overall by the reference number 18, and firmly engaged in said ends of the arm members 7 and which are illustrated in a more detailed way in FIG. 5.

More specifically, with reference to FIG. 5, the engagement members 18 of each arm member 7 comprise two cylindrical members 19,20, respectively, for example of a suitable metal material. In each cylindrical or roller member 19,20 there is formed a respective circumferential groove 21,22. Said cylindrical members are firmly coupled to the end of the respective arm member 7, in any known ways, for example by screw means, crimping, buckling, welding and/or the like.

Correspondingly, in each recess 13,14 of each jaw means 9,10 there is provided a pin, indicated at 23 and 24 respectively. Said pins 23,24, as integrally formed with said recesses, are effective to engage, during the clamping step, said respective grooves 21, 22 of each cylindrical member 19,20 thus improving the clamping of the respective arm members 7.

From the preceding description the procedure for assembling the supporting structure according to the present invention will be evident.

More specifically, the arm members 7 are inserted (FIG. 1), with the cylindrical members thereof, into respective recesses of the upper and lower jaws 9 and 10. The cylindrical or roller portions 19,20 will thus engage in corresponding recess pairs, with the respective grooves engaged with the respective pins 23 and 24.

Then the jaws 9 and 10 are caused to abut against one another, that is the base portion 12 is abutted against the base 11, and the clamping is completed by means of the screw 17 which will also fix the lower spider to the column member or upright 1.

Figure 3:
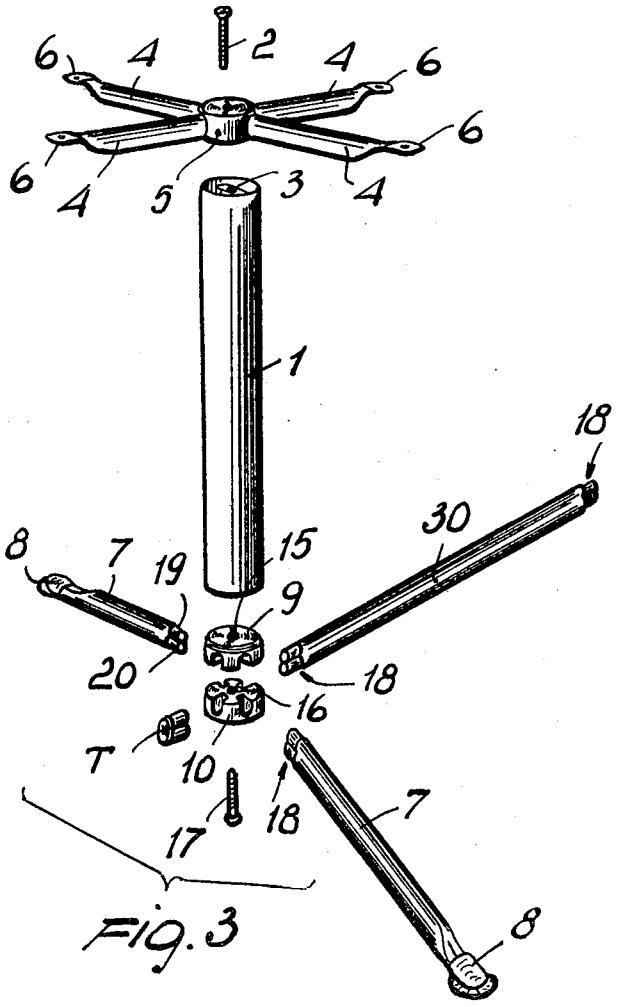
FIG. 3 is another exploded view illustrating the supporting structure according to the invention, wherein the lower arms are fewe in number the upper arms.

In FIG. 1 the number of the upper arm members substantially corresponds to the number of the lower arm members, being in both cases four. In FIG. 3, on the other hand, the number of the lower arm members is three, whereas the upper arm members are four.

In order to close the recess pair of the clamping jaws 9 and 10 not engaged by an arm member 7, being lacking, there is provided a plug member T, having such a shape effective to mate that of said recesses.

In this case, if it is desired, it is possible to couple one to another two or more modular supporting structures according to the invention, by removing the plug member T from the jaws 10 of the two structures, and inserting, into the recesses left free, a substantially rectilinear arm member, indicated at 30 in FIGS. 3 and 4. In this manner, the two structures will be associated to one another and the possibility will be afforded of supporting table and the like boards of greater size, thereby providing an important advantage.

In FIG. 2 the structure according to the invention is illustrated in its assembled condition. In this case the upper spider has a size less than that of the lower spider but, obviously, it can have a like size and, in particular, also the upper spider can be realized in a like manner as the lower spider, with obvious consequent advantages of interexchangeability of the two spiders during the making of the supporting structures.

As designed the invention fully achieves the intended objects.

In practicing the invention the used materials as well as the contingent shapes and sizes may be any, according to the needs.

I claim:

1. A modular furniture support structure, comprising:

a substantially vertically extending tubular column member;

a first set of angularly spaced radially extending arm members lying in a first plane at an upper end of said column member;

means for connecting said first set of arm members to said column member at said upper end of said column member;

a second set of radially extending arm members lying in a second plane at the lower end of said column members; and second means connecting said second set of arm members to said column member at said lower end thereof, at least one of said connecting means including:

a pair of clamping bodies each formed with a plurality of angularly spaced radially and axially open recesses registering with the recesses of the other body for receiving the respective arm members and clamping them between said bodies, each arm clamped between said bodies being tubular and having an extremity received in two registering recesses of said bodies, a screw traversing said bodies and anchored in said column member for drawing said bodies together to clamp said ends of the respective set of arm members removably between said bodies, and each of said ends is formed with a pair of cylindrical projections each provided with a circumferential groove and each of said recesses is cylindrical and said bodies are provided with pins extending radially into said recesses for engagement in said groove.

2. The structure defined in claim 1 wherein a similar column member and similar sets of arm members forming a second structure adjacent the first mentioned structure are provided and said structures are coupled by a coupling member having ends received in registering recesses of said bodies of each of said column members.

3. The structure defined in claim 1 wherein the free ends of the arm members engaged by said bodies are provided with casters.

4. The structure defined in claim 1 wherein the arm members of the set engaged by said bodies are the second arm members, the arm members of the first set being formed unitarily from sheet metal.

* * * * *